US007097901B2

(12) United States Patent
Larsson et al.

(10) Patent No.: US 7,097,901 B2
(45) Date of Patent: Aug. 29, 2006

(54) COATED CUTTING TOOL INSERT

(75) Inventors: Andreas Larsson, Fagersta (SE); Jenni Zackrisson, Fagersta (SE)

(73) Assignee: Seco Tools AB, Fagersta (SE)

( * ) Notice: Subject to any disclaimer, the term of this patent is extended or adjusted under 35 U.S.C. 154(b) by 226 days.

(21) Appl. No.: 10/780,681

(22) Filed: Feb. 19, 2004

(65) Prior Publication Data

US 2004/0197582 A1 Oct. 7, 2004

(30) Foreign Application Priority Data

Mar. 24, 2003 (SE) ..... 0300781

(51) Int. Cl.
*B32B 9/00* (2006.01)

(52) U.S. Cl. ..... 428/216; 51/307; 51/309; 428/336; 428/698; 428/701; 428/472

(58) Field of Classification Search ..... 428/216, 428/336, 698, 701, 472; 51/307, 309
See application file for complete search history.

(56) References Cited

U.S. PATENT DOCUMENTS

| | | | |
|---|---|---|---|
| 4,277,283 | A | 7/1981 | Tobioka et al. |
| 4,548,786 | A | 10/1985 | Yohe |
| 4,610,931 | A | 9/1986 | Nemeth et al. |
| 5,786,069 | A | 7/1998 | Ljungberg et al. |
| 5,945,207 | A | 8/1999 | Kutscher et al. |
| 6,200,671 | B1 | 3/2001 | Lindskog et al. |
| 6,333,100 | B1 | 12/2001 | Palmqvist et al. |
| 6,406,224 | B1 | 6/2002 | Ostlund et al. |
| 2004/0265648 | A1 | 12/2004 | Zackrisson et al. |

FOREIGN PATENT DOCUMENTS

| | | | |
|---|---|---|---|
| EP | 0 736 615 | A2 | 10/1996 |
| EP | 0 753 603 | A2 | 1/1997 |
| EP | 1 205 569 | A2 | 5/2002 |
| EP | 1 347 076 | A1 | 9/2003 |
| EP | 1 352 697 | A2 | 10/2003 |
| EP | 1 469 101 | A2 | 10/2004 |
| WO | 2005/028147 | A1 | 3/2005 |
| WO | 2005/028149 | A1 | 3/2005 |

*Primary Examiner*—Archene Turner
(74) *Attorney, Agent, or Firm*—Drinker Biddle & Reath LLP

(57) ABSTRACT

The present invention relates to a coated cemented carbide cutting tool insert particularly useful for turning of cast irons but also low alloyed steels at mediate to high cutting speeds. The cutting tool insert is characterised by a cemented carbide body comprising WC, cubic carbonitrides, a W-alloyed Co binder phase, a surface zone of the cemented carbide body that is binder phase enriched and nearly free of cubic carbonitride phase, and a coating including an innermost layer of $TiC_xN_yO_z$ with equiaxed grains, a layer of $TiC_xN_yO_z$ with columnar grains and at least one layer of $Al_2O_3$.

17 Claims, 1 Drawing Sheet

COATED CUTTING TOOL INSERT

BACKGROUND OF THE INVENTION

The present invention relates to a coated cemented carbide cutting tool insert particularly useful for turning of cast irons, but which can also be used to cut low alloyed steels at medium to high cutting speeds. The insert has a body with WC and cubic carbonitrides as hard phases, cemented with a tough Co binder phase, and a coating with high wear resistance. The insert is produced such that the surface zone of the body is of a different elemental composition than the bulk composition, yielding good wear resistance, plastic deformation resistance and edge strength simultaneously, which results in extended tool life for different machining conditions.

Today, coated cemented carbide inserts with binder phase enriched surface zones are used for machining of steel and stainless steel materials. In these medium to coarse WC grained cutting tool materials, with relatively large additions of cubic carbonitride forming elements, the binder phase enriched surface zone widens the application area towards tougher cutting operations. However, in inserts for turning of cast irons these cemented carbide grades are often not successful. Cemented carbide grades for machining of cast iron has traditionally been designed with small WC grain size, low Co content and no or very small additions of cubic carbides, for the reason of WC grain growth inhibition only. The resulting cutting tool material has relatively high room temperature hardness, fair crack propagation resistance and bulk toughness properties. At high cutting speed and/or high feed rate operations, where large amount of heat is generated, the plastic deformation resistance and sometimes also the wear resistance is limited.

Improved resistance to plastic deformation of the cutting tool insert can be reached by even further decreasing the WC grain size and lowering the Co binder phase content, and/or by increasing the addition of cubic carbonitride forming elements. However, each of these changes will simultaneously impair the toughness properties of the insert.

Methods to improve the toughness behavior by introducing an essentially cubic carbide free and binder phase enriched surface zone are known. U.S. Pat. No. 4,277,283, U.S. Pat. No. 4,610,931 and U.S. Pat. No. 4,548,786 describe methods to accomplish binder phase enrichment in the surface region by dissolution of cubic carbide phase close to the insert surfaces. The methods require that the cubic carbide phase contains some nitrogen, since dissolution of cubic carbide phase at the sintering temperature requires a partial pressure of nitrogen, nitrogen activity, within the body being sintered exceeding the partial pressure of nitrogen within the sintering atmosphere. The nitrogen can be added through the furnace atmosphere during the sintering cycle and/or directly through the powder. The dissolution of cubic carbide phase, preferentially in the surface region, results in small volumes that will be filled with binder phase giving the desired binder phase enrichment. As a result, a surface zone consisting of essentially WC and binder phase is obtained.

U.S. Pat. No. 6,333,100 relates to a coated cemented carbide insert for turning of steels. The insert has a highly alloyed Co-binder phase, a large addition of cubic carbides from about 4 to 12, preferably from about 7 to 10, percent by weight and a WC grain size of from about 1 to 4, preferably from about 2 to 3 μm. The binder phase enriched surface zone is of a thickness <20 μm and along a line in the direction from the edge to the centre of the insert the binder phase content increases essentially monotonously until it reaches the bulk composition. The coating of the insert comprises from about 3 to 12 μm of columnar TiCN and from about 2 to 12 μm of $Al_2O_3$.

U.S. Pat. No. 5,945,207 describes a cutting tool insert particularly useful for cutting of cast iron materials. The insert is characterised by a WC-Co cemented carbide body with from about 5 to 10 wt. % Co and <0.5% cubic carbides from groups IVb, Vb or VIb of the periodic table. The binder phase is highly W-alloyed and the surface composition is well defined. The coating comprises a layer of $TiC_xN_yO_z$ with columnar grains, a layer of fine-grained textured $\alpha$-$Al_2O_3$ and a top layer of $TiC_xN_yO_z$ that has been removed along the edge line.

SUMMARY OF THE INVENTION

It has now surprisingly been found that enhanced performance when machining cast iron can be obtained by combining many different features of the cutting tool insert. Specifically, it has been found that improvements with respect to plastic deformation and wear resistance, as well as edge strength can simultaneously be obtained if the tool is manufactured such that a binder phase enriched, nearly cubic carbonitride free, surface zone is combined with fine WC grain size, a relatively low addition of cubic carbonitride forming elements and low Co binder content.

When coated with a hard wear resistant coating, said cutting tool insert shows excellent performance when turning cast iron at mediate to high cutting speeds and low alloyed steels at high cutting speeds. A wider application area is obtained as the coated cemented carbide insert according to the invention performs very well under both continuous and intermittent cutting conditions.

In one aspect, there is provided a cutting tool insert particularly useful for turning of cast irons and low alloyed steels comprising a cemented carbide body and a coating, said body having a composition of from about 3.0 to 8.0 wt. % Co, from about 0.5 to 4.0 wt. % of cubic carbonitride forming elements from groups IVb and Vb of the periodic table, N, C, and WC, and a from about 5 to 40 μm thick surface zone which is binder phase enriched and nearly free of cubic carbonitride phase, with a maximum binder phase content in the surface zone of from about 1.2 to 3 by volume of the bulk binder phase content, said coating comprising:

- a first, innermost layer of $TiC_xN_yO_z$ with $0.7 \leqq x+y+z \leqq 1$, with equiaxed grains and a total thickness <2 μm;
- a layer of $TiC_xN_yO_z$ with $0.7 \leqq x+y+z \leqq 1$, with a thickness of from about 3 to 14 μm, with columnar grains; and
- at least one layer of $AlO_3$ with a thickness of from about 2 to 14 μm

DETAILED DESCRIPTION OF THE INVENTION

Figure 1:
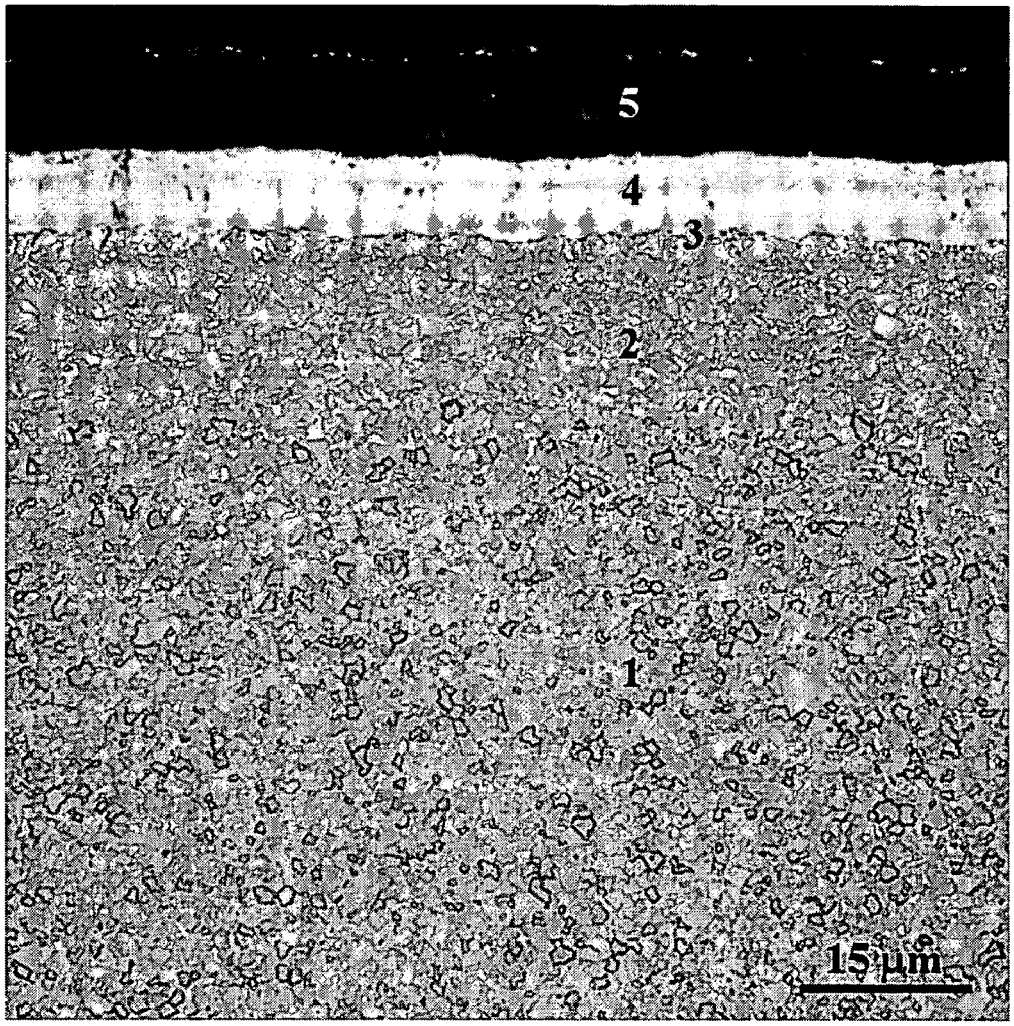
FIG. 1 shows in 1000X the structure of the cutting tool insert according to the invention in which 1. Cemented carbide bulk
2. Cemented carbide surface zone
3. An innermost $TiC_xN_yO_z$ layer
4. A $TiC_xN_yO_z$ layer with columnar grains
5. An $Al_2O_3$ layer

According to the present invention, a coated cutting tool is provided with a cemented carbide body having a composition of from about 3.0 to 8.0 wt. %, preferably from about 4.5 to 7.0 wt. % Co, from about 0.5 to 4.0 wt. %, preferably from about 1.0 to 4.0 wt.% of cubic carbonitride forming elements from groups IVb and Vb of the periodic table, N, C and WC. N is present in the sintered body in an amount corresponding to >1.0%, preferably from about 1.7 to 5.0%, of the weight of the elements from groups IVb and Vb.

The cemented carbide has a from about 5 to 40 μm, preferably from about 10 to 30 μm, thick surface zone, which is binder phase enriched and nearly free of cubic carbonitride phase. The maximum binder phase content of the surface zone is from about 1.2 to 3 by volume of the bulk binder phase content.

The cobalt binder phase is medium to highly alloyed with tungsten. The content of tungsten in the binder phase may be expressed as the S-value=σ/16.1, where σ is the measured magnetic moment of the binder phase in $\mu Tm^3kg^{-1}$. The S-value depends on the tungsten content of the binder phase and increases with a decreasing tungsten content. Thus, for pure cobalt, or a binder that is saturated with carbon, S=1, and for a binder phase with a tungsten content corresponding to the borderline to η-phase formation, S=0.78.

It has now also been found according to the present invention that improved cutting performance is achieved if the cemented carbide body has an S-value within the range from about 0.78 to 0.94, preferably from about 0.81 to 0.92.

Furthermore, the mean intercept length of the tungsten carbide phase measured on a ground and polished representative cross section is in the range from about 0.35 to 0.85 μm, preferably from about 0.45 to 0.75 μm. The mean intercept length of the cubic carbonitride phase is essentially the same as for tungsten carbide. The intercept length is measured by means of image analysis on micrographs with a magnification of 10000X and calculated as the average mean value of approximately 1000 intercept lengths.

In a preferred embodiment, the amount of cubic carbonitrides corresponds to from about 0.5 to 4.0% by weight of the cubic carbonitride forming elements titanium, tantalum and niobium, preferably from about 1.0 to 4.0% by weight. The ratio between tantalum and niobium is within from about 0.8 to 4.5 by weight, preferably from about 1.2 to 3.0 by weight. The ratio between titanium and niobium is within from about 0.5 to 7.0 by weight, preferably from about 1.0 to 4.0 by weight.

The cutting tool insert according to the invention has a coating comprising:

- a first, innermost layer of $TiC_xN_yO_z$ with $0.7 \leqq x+y+z \leqq 1$, preferably from about z<0.5, more preferably y>x and z<0.2, most preferably y>0.7, with equiaxed grains and a total thickness <2 μm, preferably >0.1 μm.
- a layer of $TiC_xN_yO_z$ with $0.7 \leqq x+y+z \leqq 1$, preferably with z<0.2, x>0.3 and y>0.2, most preferably x>0.4, with a thickness of from about 3 to 14 μm, preferably from about 4 to 12 μm, most preferably from about 5 to 10 μm with columnar grains.
- at least one layer of $Al_2O_3$, preferably α-$Al_2O_3$, with a thickness of from about 2 to 14 μm, preferably from about 3 to 10 μm.
- the outer layer of $Al_2O_3$ can be followed by further layers of $TiC_xN_yO_z$, $HfC_xN_yO_z$ or $ZrC_xN_yO_z$ or mixtures thereof with $0.7 \leqq x+y+z \leqq 1.2$, preferably with y>x and z<0.4, more preferably y>0.4, most preferably y>0.7, with thickness <3 μm, preferably from about 0.4 to 1.5 μm, but the $Al_2O_3$ layer can also be the outermost layer.

Production of the cemented carbide body according to the invention is done in either of two ways or a combination thereof: (i) by sintering a presintered or compacted body containing a nitride or a carbonitride in an inert atmosphere or in vacuum as disclosed in U.S. Pat. No. 4,610,931, the disclosure of which is hereby incorporated by references; or (ii) by nitriding the compacted body as disclosed in U.S. Pat. No. 4,548,786, the disclosure of which is hereby incorporated by references, followed by sintering in an inert atmosphere or in vacuum.

The desired mean intercept length depends on the grain size of the starting powders and milling and sintering conditions and has to be determined by experiments. The desired S-value depends on the starting powders and sintering conditions and also has to be determined by experiments within the purview of the skilled artisan.

The layer of $TiC_xN_yO_z$ with 0.7<x+y+z<1, preferably with z<0.2, x>0.3 and y>0.2, most preferably x>0.4, having a morphology of columnar grains, is deposited with MTCVD-technique onto the cemented carbide using acetonitrile as the carbon and nitrogen source for forming the layer in the temperature range of from about 700 to 950° C.

The innermost $TiC_xN_yO_z$ layer, the $Al_2O_3$ layers and subsequent $TiC_xN_yO_z$, $HfC_xN_yO_z$ or $ZrC_xN_yO_z$ layers are deposited according to known techniques.

The invention also relates to the use of cutting tool inserts according to the above for turning in cast irons and low alloyed steels at mediate and high cutting speeds, that is, at cutting speeds of from about 100 to 700 m/min, preferably from about 100 to 600 m/min, with feed values of from about 0.04 to 0.80 mm/rev., depending on cutting speed and insert geometry.

The invention is additionally illustrated in connection with the following Examples, which are to be considered as illustrative of the present invention. It should be understood, however, that the invention is not limited to the specific details of the Examples

EXAMPLE 1

Grade A: A cemented carbide substrate in accordance with the invention with the composition 5.6 wt % Co, 1.5 wt % Ta, 0.9 wt % Nb, 1.5 wt % Ti, 5.98 wt % C, 0.08 wt % N, balance W, with a binder phase alloyed with W corresponding to an S-value of 0.91 was produced by conventional milling of powders, pressing of green compacts and subsequent sintering at 1430° C. Investigation of the microstructure after sintering showed that the mean intercept length of the tungsten carbide phase was 0.58 μm and that the surface zone of the inserts consisted of a 15 μm thick binder phase enriched part nearly free of cubic carbonitride phase. The substrate was coated in accordance with the invention with subsequent layers deposited during the same coating cycle. The first layer was a 0.2 μm thick $TiC_xN_yO_z$ layer with z<0.1 and y>0.6, having equiaxed grains. The second layer was 6.8 μm of columnar $TiC_xN_yO_z$ deposited at 835–850° C. with acetonitrile as carbon and nitrogen source, yielding an approximated carbon to nitrogen ratio x/y=1.5 with z<0.1. A 7.2 μm thick layer of $Al_2O_3$, consisting of the α-phase, was deposited at approximately 1000° C. An outer layer of equiaxed nitrogen rich $TiC_xN_yO_z$ with z<0.1 and y>0.8 was deposited to a thickness of 0.4 μm.

Grade B: A cemented carbide substrate in accordance with the invention with the composition 5.6 wt % Co, 1.0 wt % Ta, 0.6 wt % Nb, 1.9 wt % Ti, 6.01 wt % C, 0.13 wt % N, balance W, with a binder phase alloyed with W corresponding to an S-value of 0.89 was produced in the same way as Grade A. The mean intercept length of the tungsten carbide phase after sintering was 0.56 μm and the surface zone of the inserts consisted of a 20 μm thick binder phase enriched part nearly free of cubic carbonitride phase. The substrate was coated in the same way as Grade A (according to the invention).

Grade C: A conventional cemented carbide substrate designed for cast iron machining, with the composition 6.0 wt % Co, 0.16 wt % Ta, 5.80 wt % C and balance W, a binder phase alloyed with W corresponding to an S-value of 0.94, and a mean intercept length of WC in the sintered body of 0.61 μm was combined with a coating made in the same way as Grade A (according to the invention).

Grade D: A substrate with average composition 5.5 wt % Co, 1.5 wt % Ta, 1.3 wt % Nb, 5.86 wt % C and balance W, having no cubic carbonitride free surface zone, a binder phase alloyed with W corresponding to an S-value of 0.89, and a mean intercept length of WC in the sintered body of 0.57 μm was combined with a coating made in the same way as Grade A (according to the invention).

Grade A, Grade B, Grade C, and Grade D were tested with respect to edge toughness in the case of interrupted cuts. The machining operation was longitudinal turning of a cylindrical slotted bar.

Material: Steel SS1672

Insert type: CNMG120412-M5

Cutting speed: 140 m/min

Feed: 0.1, 0.125, 0.16, 0.20, 0.25, 0.315, 0.4, 0.5, 0.63, 0.8 mm/rev gradually increased after 10 mm length of cut Depth of cut: 2.5 mm Tool life criteria: Edge chipping or inserts breakage.

| Results | Mean feed at breakage (mm/rev.) |
|---|---|
| Grade A (Grade according to the invention) | 0.36 |
| Grade B (Grade according to the invention) | 0.20 |
| Grade C (Coating according to the invention) | 0.20 |
| Grade D (Coating according to the invention) | 0.15 |

This test shows that combinations of the substrate and coating according to the invention exhibit equal or superior edge toughness as compared to what is usually obtained with a conventional cast iron machining grade. The test also shows the detrimental effects that cubic carbonitride phase additions have on edge toughness if a gradient surface zone is not formed.

EXAMPLE 2

Inserts according to Grade A, Grade C, and Grade D were tested in longitudinal turning of a grey cast iron. The plastic deformation resistance of the different grades was investigated and compared.

| | |
|---|---|
| Material: | Grey cast iron, SS0125 |
| Insert type: | CNMG120412-M5 |
| Cutting speed: | 350 m/min |
| Feed: | 0.4 mm/rev. |
| Depth of cut: | 2.5 mm |
| Coolant: | No |
| Time in cut: | 5 min |

| Results: | Edge depression |
|---|---|
| Grade A (Grade according to the invention) | 25 μm |
| Grade C (Coating according to the invention) | 30 μm |
| Grade D (Coating according to the invention) | 25 μm |

As is shown in this test, the plastic deformation resistance of Grade A is not impaired by the presence of the Co enriched cubic carbonitride free surface zone.

EXAMPLE 3

Grade E: A conventional cemented carbide substrate designed for steel machining, with composition 5.5 wt % Co, 3.3 wt % Ta, 2.1 wt % Nb, 2.0 wt % Ti, 6.0 wt % C, 0.2 wt % N and balance W was combined with a coating according to Grade A (according to the invention). The substrate of the cutting tool had a 25 μm deep surface zone essentially free of cubic carbonitride phases, an average binder phase alloyed with W corresponding to an S-value of 0.85, and a mean intercept length of the WC in the sintered body of 0.73 μm.

Grade F: A commercial cemented carbide grade for cast iron machining in which a substrate according to Grade C is combined with a coating consisting of: a first thin layer of $TiC_xN_yO_z$; a second layer of columnar $TiC_xN_yO_z$ with thickness 6.2 μm; a 2.1 μm thick layer of $\alpha$-$Al_2O_3$; and an outermost 1.2 μm thick N-rich $TiC_xN_yO_z$ layer.

Inserts according to Grade A, Grade C, Grade E and Grade F were tested in roughing of a grey cast iron component. The component had cast skin and the geometrical shaping resulted in intermittent cutting conditions. The tool life criteria was the occurrence of burr on component corners.

| | |
|---|---|
| Material: | Grey cast iron, SS0130 |
| Component | Belt pulley |
| Insert type: | WNMG080412-MR7 |
| Cutting speed: | 300 m/min |
| Feed: | 0.4 mm/rev. |
| Depth of cut: | 3.0 mm |
| Coolant: | No |

| Results: | Number of produced pieces |
|---|---|
| Grade A (Grade according to the invention) | 23 |
| Grade C (Coating according to the invention) | 18 |
| Grade E (Coating according to the invention) | 11 |
| Grade F (Prior art) | 15 |

The results from this operation show that the grade according to the invention holds a very good combination of wear resistance and edge toughness properties. The wear of Grades C and E is characterised by edge chipping. The large addition of cubic carbonitride phase forming elements and the larger WC grain size gives Grade E a more brittle behavior in this cast iron machining operation. The wear of Grade F is characterised by abrasive wear due to the relatively thin coating.

EXAMPLE 4

Inserts according to Grade A, Grade B, Grade C, Grade D, Grade E, and Grade F were tested in a facing operation in nodular cast iron. The tool life criterion was a flank wear exceeding 0.4 mm. The rake faces of the inserts of Grade A, Grade B and Grade E were not ground.

| | |
|---|---|
| Material: | Nodular cast iron, SS0732 |
| Component | Cylinder |
| Insert type: | WNMA080412 |
| Cutting speed: | 250 m/min |
| Feed: | 0.3 mm/rev. |
| Depth of cut: | 3.0 mm |
| Cutting conditions: | Heavy interrupted cut |
| Coolant: | Yes |

| Results: | Number of produced components |
|---|---|
| Grade A (Grade according to the invention) | 30 |
| Grade B (Grade according to the invention) | 32 |
| Grade C (Coating according to the invention) | 25 |
| Grade D (Coating according to the invention) | 15 |
| Grade E (Coating according to the invention) | 15 |
| Grade F (Prior art) | 20 |

EXAMPLE 5

Inserts according to Grade A, Grade C, Grade E and Grade F were tested in an external operation in nodular cast iron. The tool life criterion was a poor surface finish due to flank wear or edge chipping.

| | |
|---|---|
| Material: | Nodular cast iron, SS0732 |
| Component | Housing |
| Insert type: | CNMG120412-MR7 |
| Cutting speed: | 250 m/min |
| Feed: | 0.4 mm/rev. |
| Depth of cut: | 2.0 mm |
| Cutting conditions: | Severe interruption |
| Coolant: | Yes |

| Results: | Number of produced components |
|---|---|
| Grade A (Grade according to the invention) | 32 |
| Grade C (Coating according to the invention) | 26 |
| Grade E (Coating according to the invention) | 28 |
| Grade F (Prior art) | 28 |

The tool life of Grade A and Grade F was mainly limited by flank wear, while the tool life of Grade C and Grade E was limited by edge chipping.

EXAMPLE 6

Inserts according to Grade A, Grade B, Grade C, and Grade E were tested in longitudinal turning of a low alloyed steel. The plastic deformation resistance of the different grades was investigated and compared.

| | |
|---|---|
| Material: | Low alloy steel, SS1672 |
| Insert type: | CNMG120412-M5 |
| Cutting speed: | 600 m/min |
| Feed: | 0.4 mm/rev. |
| Depth of cut: | 2.5 mm |
| Coolant: | No |
| Time in cut: | 1 min |

| Results: | Edge depression |
|---|---|
| Grade A (Grade according to the invention) | 25 m |
| Grade B (Grade according to the invention) | 20 m |
| Grade C (Coating according to the invention) | 35 m |
| Grade E (Coating according to the invention) | 20 m |

In this test, Grade A and Grade B show better deformation resistance than Grade C, the tool with a conventional substrate for cast iron turning. The performance of Grade B is equal to that of Grade E.

The principles, preferred embodiments, and modes of operation of the present invention have been described in the foregoing specification. The invention, which is intended to be protected herein, however, is not to be construed as limited to the particular forms disclosed, since these are to be regarded as illustrative rather than restrictive. Variations and changes may be made by those skilled in the art without departing from the spirit of the invention.

The invention claimed is:

1. A cutting tool insert for turning of cast irons and low alloyed steels, comprising a cemented carbide body and a coating, said body having a composition of from about 3.0 to 8.0 wt. % Co, from about 0.5 to 4.0 wt. % of cubic carbonitride forming elements from groups IVb and Vb of the periodic table, N, C, and WC, and a from about 5 to 40 μm thick surface zone which is binder phase enriched and nearly free of cubic carbonitride phase, with a maximum binder phase content in the surface zone of from about 1.2 to 3 by volume of the bulk binder phase content, said coating comprising:

a first, innermost layer of $TiC_xN_yO_z$ with $0.7 \leqq x+y+z \leqq 1$, with equiaxed grains and a total thickness <2 μm;

a layer of $TiC_xN_yO_z$ with $0.7 \leqq x+y+z \leqq 1$, with a thickness of from about 3 to 14 μm, with columnar grains; and at least one layer of $\alpha$-$Al_2O_3$ with a thickness of from about 2 to 14 μm.

2. The cutting tool insert of claim 1 wherein said body has a composition of from about 4.5 to 7.0 wt. % Co, from about 1.0 to 4.0 wt. % of cubic carbonitride forming elements from groups IVb and Vb of the periodic table and wherein said coating further comprises:

said first, innermost layer of $TiC_xN_yO_z$ with z<0.5 with equiaxed grains and a total thickness >0.1 μm;

said layer of $TiC_xN_yO_z$ with z<0.2, x>0.3 and y>0.2 with a thickness of from about 4 to 12 μm with columnar grains; and said least one layer of $\alpha$-$Al_2O_3$ has a thickness of from about 3 to 10 μm.

3. The cutting tool insert of claim 2 wherein said coating comprises:

said first, innermost layer of $TiC_xN_yO_z$ withy>x and z<0.2 with equiaxed grains and said total thickness >0.1 μm; and said layer of $TiC_xN_yO_z$ with x>0.4 with said thickness of from about 5 to 10 μm with columnar grains.

4. The cutting tool insert of claim 3 said said first, innermost layer of $TiC_xN_yO_z$ has y>0.7.

5. The cutting tool insert of claim 1 further comprising an outer layer of $TiC_xN_yO_z$, $HfC_xN_yO_z$ or $ZrC_xN_yO_z$ or mixtures thereof with $0.7 \leqq x+y+z \leqq 1.2$ with a thickness <3 μm.

6. The cutting tool insert of claim 5 wherein said outer layer comprises $TiC_xN_yO_z$, $HfC_xN_yO_z$ or $ZrC_xN_yO_z$ or mixtures thereof with y>x and z<0.4 with said thickness from about 0.4 to 1.5 μm.

7. The cutting tool insert of claim 6 wherein said outer layer comprises $TiC_xN_yO_z$, $HfC_xN_yO_z$ or $ZrC_xN_yO_z$ or mixtures thereof with y>0.4.

8. The cutting tool insert of claim 7 wherein said outer layer comprises $TiC_xN_yO_z$, $HfC_xN_yO_z$ or $ZrC_xN_yO_z$ or mixtures thereof with y>0.7.

9. The cutting tool insert of claim 1 wherein a S-value of the cemented carbide body is within a range from about 0.78 to 0.94 and a mean intercept length of the WC phase is from about 0.35 to 0.85 μm.

10. The cutting tool insert of claim 9 wherein the S-value of the cemented carbide body is within the range from about 0.81 to 0.92 and the mean intercept length of the WC phase is from about 0.45 to 0.75 μm.

11. The cutting tool insert of claim 1 wherein N is present in the sintered body in an amount corresponding to >1.0% of the weight of the elements from groups IVb and Vb of the periodic table.

12. The cutting tool insert of claim 11 wherein N is present in the sintered body in an amount corresponding from about 1.7 to 5.0% of the weight of the elements from groups IVb and Vb of the periodic table.

13. The cutting tool insert of claim 1 wherein the amount of cubic carbonitrides corresponds to from about 0.5 to 4.0% by weight of the cubic carbonitride forming elements titanium, tantalum and niobium.

14. The cutting tool insert of claim 13 wherein the amount of cubic carbonitrides corresponds to from about 1.0 to 4.0% by weight of the cubic carbonitride forming elements titanium, tantalum and niobium.

15. The cutting tool insert of claim 13 wherein a ratio between tantalum and niobium is within from about 0.8 to 4.5 by weight and a ratio between titanium and niobium is within from about 0.5 to 7.0 by weight.

16. The cutting tool insert of claim 15 wherein the ratio between tantalum and niobium is within from about 1.2 to 3.0 by weight and the ratio between titanium and niobium is within from about 1.0 to 4.0 by weight.

17. Use of a cutting tool insert according to claim 1 for turning in cast irons and low alloyed steels at cutting speeds of 100–700 m/min with feed values of from about 0.04 to 0.80 mm/rev.

* * * * *